US007992731B2

(12) United States Patent
Mcallister et al.

(10) Patent No.: US 7,992,731 B2
(45) Date of Patent: Aug. 9, 2011

(54) MULTI-COMPONENT CONICAL CORNER STRUCTURE FOR SHELVING

(75) Inventors: Larry N. Mcallister, Dover, DE (US); Kenneth S. Christianson, Clayton, DE (US)

(73) Assignee: Metal Masters Foodservice Equipment Co., Inc., Clayton, DE (US)

( * ) Notice: Subject to any disclaimer, the term of this patent is extended or adjusted under 35 U.S.C. 154(b) by 484 days.

(21) Appl. No.: 12/264,527

(22) Filed: Nov. 4, 2008

(65) Prior Publication Data

US 2010/0108631 A1 May 6, 2010

(51) Int. Cl.
*A47B 9/08* (2006.01)
*A47B 43/00* (2006.01)

(52) U.S. Cl. ..... 211/187; 108/147.12; 108/147.13; 108/107

(58) Field of Classification Search ..... 211/103, 211/187, 190, 207, 134, 181.1; 108/147.11–147.15, 108/106, 107, 110, 192, 193; 248/243
See application file for complete search history.

(56) References Cited

U.S. PATENT DOCUMENTS 4,128,064 A * 12/1978 Chung et al. ..... 108/192
4,230,052 A * 10/1980 Champagne ..... 108/147.14
4,750,626 A 6/1988 Nicely
5,279,231 A * 1/1994 Kolvites et al. ..... 108/107
5,354,025 A * 10/1994 McCaffrey ..... 248/188
6,015,052 A 1/2000 Goldberg et al.
6,622,876 B2 9/2003 Goldberg
6,905,037 B1 6/2005 Goldberg
7,059,484 B1 6/2006 Goldberg
7,478,971 B2 * 1/2009 Li ..... 403/398
7,568,436 B2 * 8/2009 McAllister et al. ..... 108/147.12

* cited by examiner

*Primary Examiner* — Jennifer E. Novosad
(74) *Attorney, Agent, or Firm* — Connolly Bove Lodge & Hutz LLP

(57) ABSTRACT

A shelving unit comprises a plurality of upright support posts and shelves having multiple corners with multi-component corner structure at each corner of the shelf for releasably connecting the shelf to the posts. Each corner structure comprises a two piece base segment and a substantially frictionless outside interlocking segment. The two piece base segment includes a housing fixedly connected to a shelf corner and a substantially frictionless inner liner within the housing. The outside interconnecting segment includes outwardly extending flanges that engage vertically oriented opposed undercut slots on the inner liner to facilitate interconnection of the base and interlocking segments. Both segments include partial frusto conical surface portions that engage a frusto conical clamping sleeve on the support posts to facilitate releasable connection of the shelf to the posts. The substantially frictionless material of the inner liner and outside interlocking segment enables ease of assembly and disassembly as well as a tight wedging fit of the components.

12 Claims, 5 Drawing Sheets

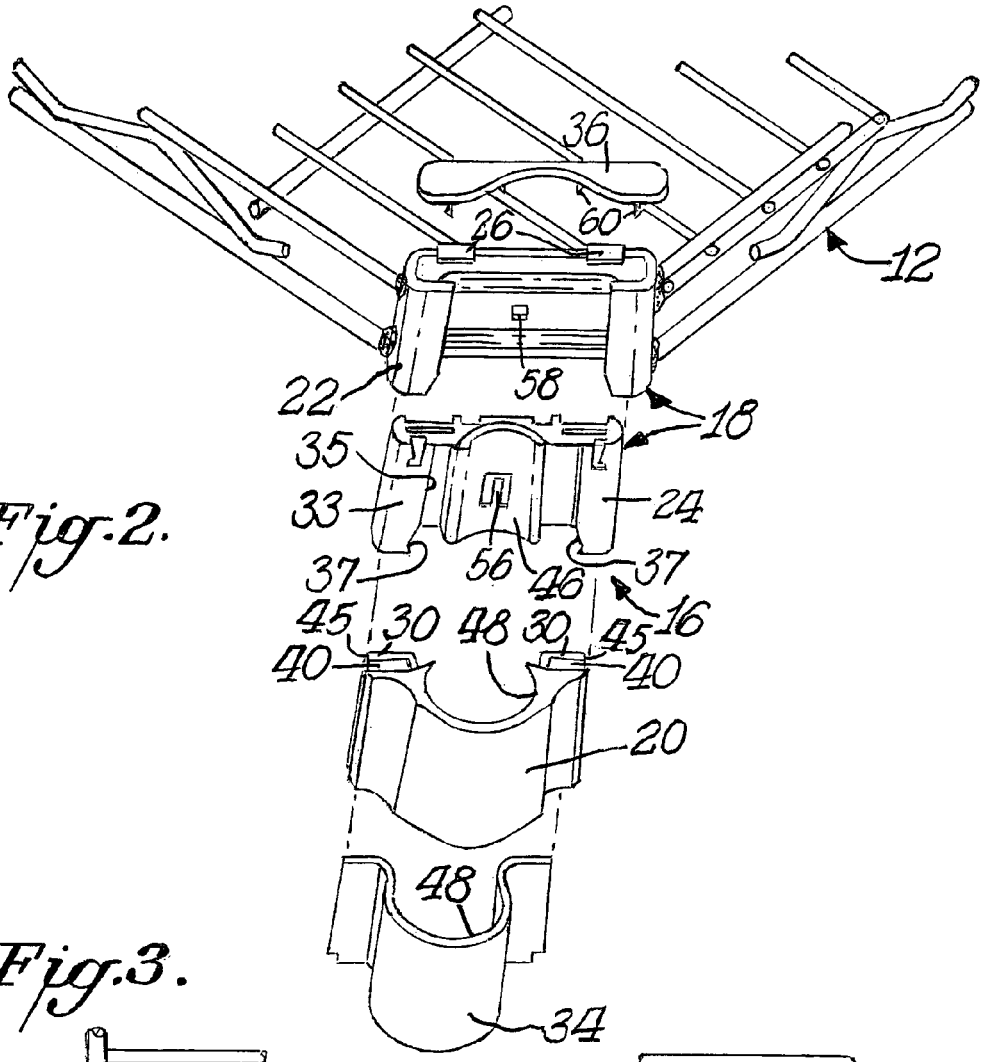
Fig. 2.
Fig. 3.
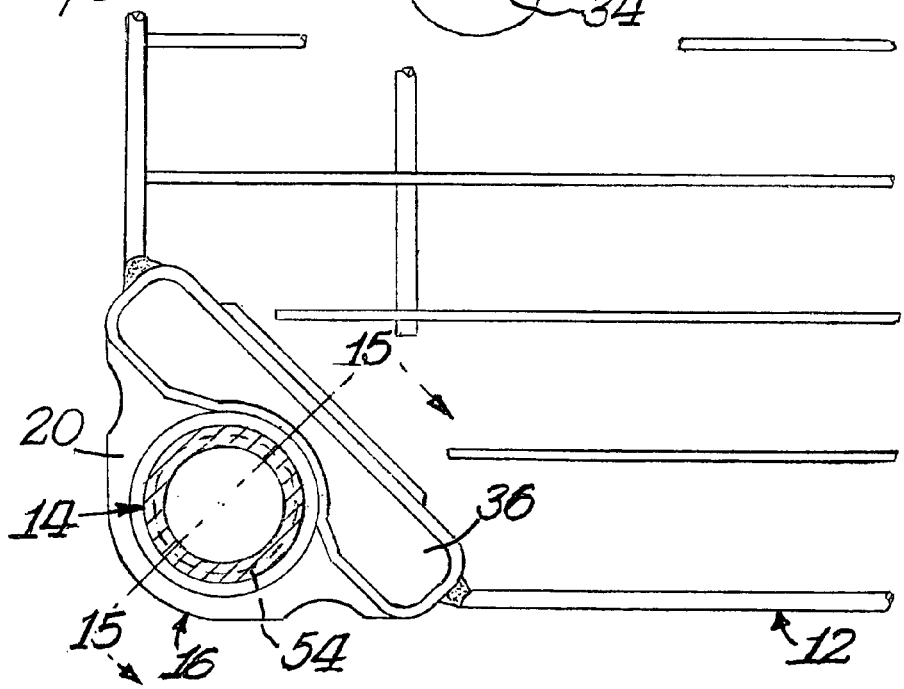

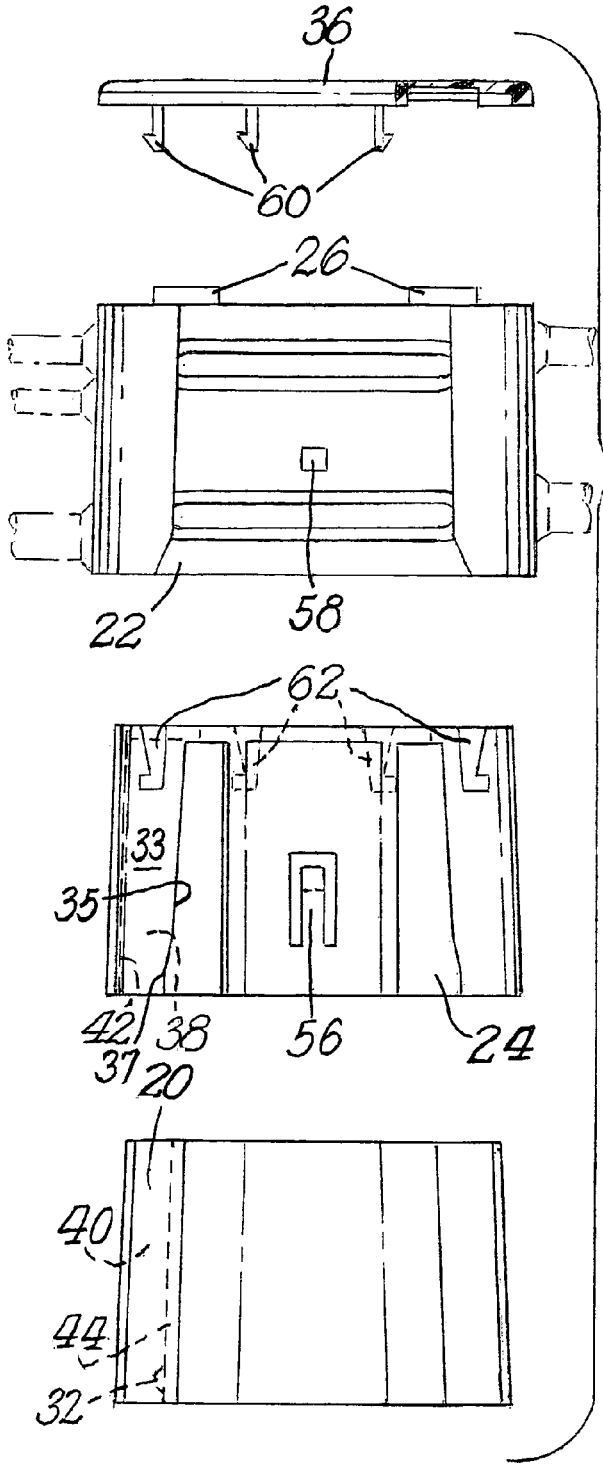
Fig. 11.
Fig. 14.
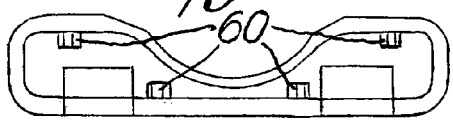
Fig. 13.
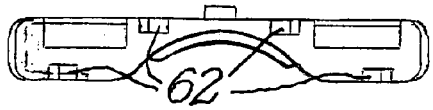
Fig. 12.
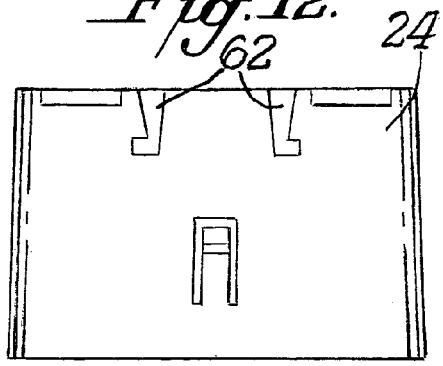
Fig. 15.
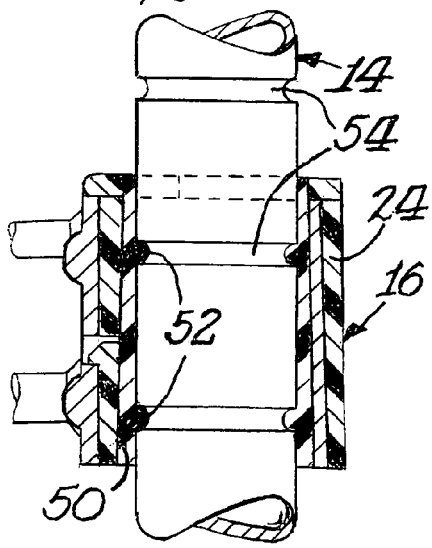

MULTI-COMPONENT CONICAL CORNER STRUCTURE FOR SHELVING

BACKGROUND OF THE INVENTION

The present invention relates to shelving and, more specifically, to an improved shelving unit having shelves with multi-component conical corner structure which facilitates the mounting on or removal of a shelf relative to upstanding corner posts without the necessity of initially removing adjacent shelves connected to the posts.

Adjustable shelving units employing shelves constructed of sheet metal or wire are well known and extensively utilized. They are particularly intended to be readily assembled and disassembled. For this purpose, the shelving normally utilizes corner structures for securing the shelves to upright posts. In situations where strength and rigidity of the assembled shelving unit is of significance, the corner structure generally employs a conical collar arrangement which totally surrounds the corner post to achieve a secure and rigid clamping engagement with the post. Such corner structure, however, not only makes assembly of the shelving unit more complex since the conical collar must be slidably inserted over the post from one end, but this corner structure also makes partial disassembly or rearrangement of the shelves more difficult. For example, with most known shelving units employing a corner structure of this type, the corner structure does not permit a bottom or intermediate shelf to be mounted on or removed from the posts after the shelving unit has been assembled due to the inability to position a corner structure in surrounding relationship to the post. Hence, the entire shelving unit must be reassembled.

A known shelving unit of the above type which has achieved significant commercial success provides conical collar corner structures which telescope downwardly over upstanding support posts, and conical clamping sleeves which are normally diametrically split into two pieces and which are wedgingly interposed between the collars and posts. This arrangement, wherein the intermediate conical clamping sleeve is utilized, has proven desirable inasmuch as this positively ensures a positive wedging and hence secure engagement of the shelf with respect to the posts so as to provide an extremely strong connection. The shelving units employing this intermediate conical sleeve, however, have still normally possessed features which have been considered undesirable with respect to the required assembly and disassembly techniques, the inability to add or remove intermediate shelves, and the general overall structural and functional complexities associated with some of the collar structures.

Multi-component corner constructions has been proposed which enable an intermediate shelf to be added or removed without initially removing adjacent shelves such as disclosed in U.S. Pat. No. 4,750,626. A two piece corner structure at each of the four corners of a shelf permits the shelf to be connected to or removed from four supporting corner posts without the necessity of removing the shelving directly above or below in the overall shelving system. However, extreme wedging action and friction hold the two piece corner constructions together when secured to the posts and later separation for shelf removal is quite difficult and problematic.

SUMMARY OF THE INVENTION

Accordingly, it is an object of the present invention to provide an improved adjustable shelving unit having shelves with an improved corner structure co-acting between the shelves and the upstanding support posts, which corner structure permits and retains the utilization of a intermediate conical clamping sleeve interposed between the post and the corner structure, but at the same time this improved corner structure overcomes many of the disadvantages associated with prior shelving units of this general type. More specifically, the improved corner structure of the present invention facilitates the assembly and disassembly of the shelves, including the assembly or disassembly of an intermediate shelf with respect to an assembled shelving unit, and permits the corner structure to be efficiently and economically fabricated while at the same time providing not only greatly increased flexibility but also providing a compact corner structure having a desirable appearance when assembled into the shelving unit.

Also included among the objects of the present invention is a corner structure which is not only easily assembled when attached to an upright support post, but also easily disassembled when removed from the post.

In accordance with the present invention, a shelving system comprises a plurality of upright support posts, a shelf having multiple corners, and a multi-component corner structure at each corner of the shelf for releasably connecting the shelf to the posts. Each corner structure includes a base segment having a metal housing fixedly connected to the shelf and a separate inner liner of substantially friction free material releasably secured to the metal housing. An outside interlocking segment is releasably secured to the base segment and the outside interlocking segment has an outer portion of substantially friction free material and an inner metal liner.

BRIEF DESCRIPTION OF THE DRAWINGS

Novel features and advantages of the present invention in addition to those mentioned above will become apparent to persons of ordinary skill in the art from a reading of the following detailed description in conjunction with the accompanying drawings wherein similar reference characters refer to similar parts and in which:

FIG. 2 is an exploded perspective view of a multi-component conical corner structure for the individual shelves of the shelving unit of FIG. 1, according to the present invention;

FIG. 3 is a top plan view of the corner structure of FIG. 2 in its assembled condition;

FIG. 11 is an exploded front elevational view showing the component parts of the corner structure of the present invention;

FIG. 12 is a rear elevational view of the liner of the base segment of the corner structure;

FIG. 13 is a top plan view of the liner of FIG. 12;

FIG. 14 is a bottom plan view of the corner cap; and

FIG. 15 is a cross-section view taken along line 15-15 of FIG. 3 with the support post in elevation.

DETAILED DESCRIPTION OF THE INVENTION

Figure 1:
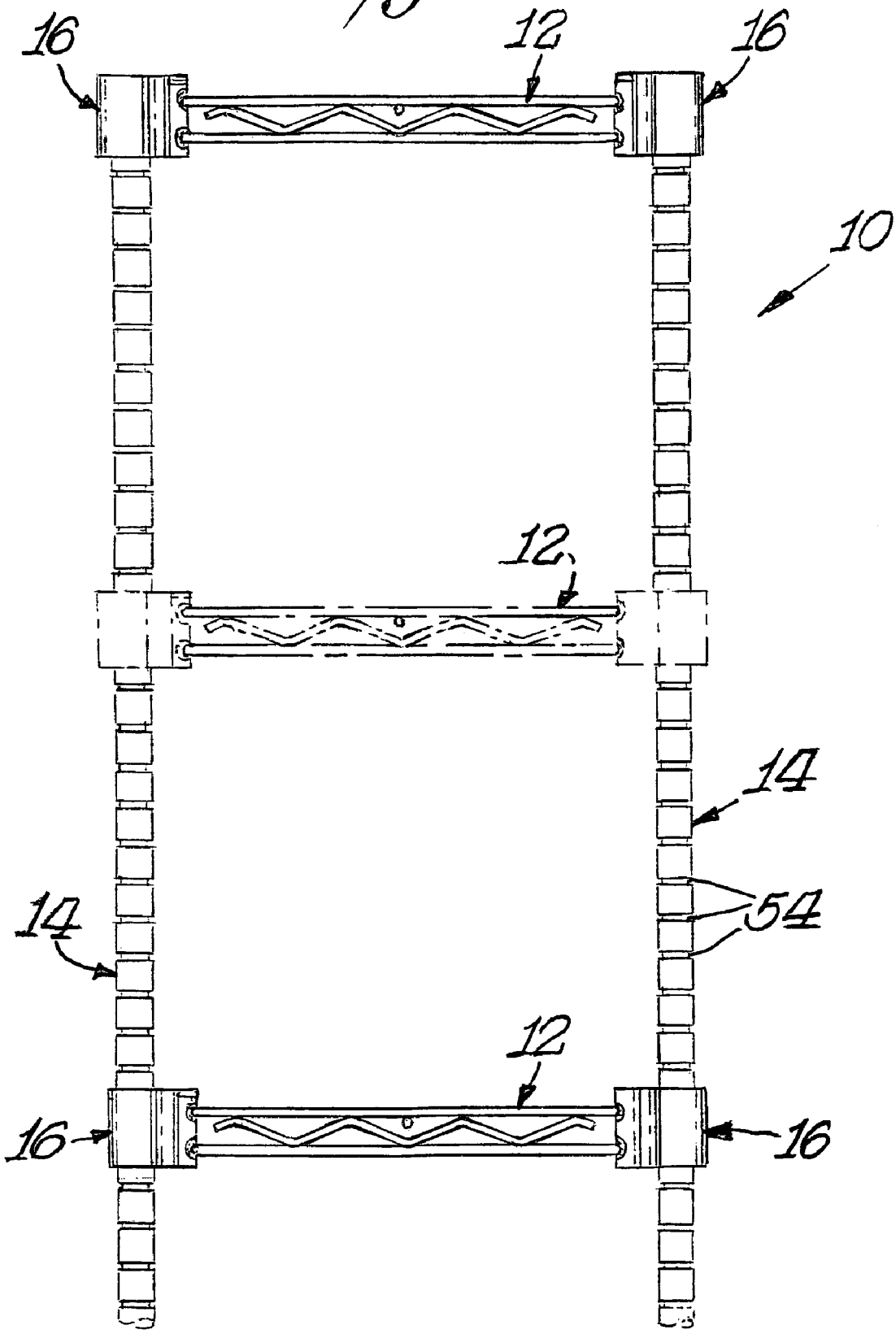
FIG. 1 is an end elevational view of a shelving unit, according to the present invention.

Referring in more particularity to the drawings, FIGS. 1-3 illustrate an adjustable shelving unit 10 according to the present invention. Shelving unit 10 includes a plurality of substantially horizontal shelves 12 arranged in parallel relationship to one another with vertical spacing between adjacent shelves. The shelves 12 are supported by a plurality of upright support posts 14, and in the embodiment illustrated in FIG. 1, four posts are used with one post at each corner of the substantially parallel and rectangular shelves 12. As explained more fully below, the corner of each shelf 12 includes a multi-component corner structure 16 for releasable attachment to a respective support post 14 of the shelving unit 10.

The corner structure 16 of the present invention basically comprises a two piece base segment 18 connected to the shelf 12 and a separate outside interlocking segment 20 constructed and arranged for releasable attachment to the base segment. In this regard, each two piece base segment 18 includes a housing 22 fixedly connected to a shelf corner, and a substantially frictionless cooperating inner liner 24 within the housing. A stop, preferably a pair of spaced apart stops 26, on an upper portion of the housing 22 engages the cooperating liner to prevent upward movement of the liner beyond the upper portion of the housing 22. The liner 24 includes vertically oriented opposed undercut slots 28 for purposes of making engagement with the outside interlocking segment 20 of the corner structure 16.

The outside interlocking segment 20 includes vertically oriented opposed outwardly directed flanges 30 that engage within the undercut slots of the liner 24 when the base and outside interlocking segments 18, 20 are releasably connected together. The stops 26 on the upper portion of the housing 22 engage the upper portion of the outwardly directed flanges 30 on the outside interlocking segment 20 to prevent further upward movement of the outside interlocking segment 20 beyond the upper portion of the liner and the housing 22.

Preferably, the outside interlocking segment 20 includes a separate metal liner 34 on an inside surface thereof for purposes of increasing the strength and dimensional stability of the outside segment and for engagement with the upstanding posts 14. The upper portion of the metal liner 34 also contacts the stops 26 on the housing the same as the upper portion of the flanges 30 of outside segment 20. Also, the multi-component corner structure 16 may further include a releasably connected cover cap 36 fitted over the base and outside interlocking segments 18, 20 when those segments are releasably assembled together. The cover cap enhances the appearance of the corner structure 16 while preventing foreign matter from becoming lodged within interior portions of the corner structure. Specifically, the cover cap 36 is releasably connected to the liner 24, as explained more fully below.

As noted above the liner 24 of the base segment 18 and the outside interlocking segment 20 are fabricated from substantially frictionless material so that these components are easily fitted together and disassembled from one another. The frictionless material may be a nylon polymer and the like. Moreover, the cover cap 36 may also be fabricated from the same material so that the components when assembled have of the same appearance when viewed from outside.

The vertically oriented opposed undercut slots 28 on the liner 24 each include an upwardly and inwardly tapered surface 38 (inwardly tapered toward the shelf), and the flanges 30 on the outside interlocking segment 20 each include a cooperating downwardly and outwardly tapered surface 40. The tapered surfaces 38 of the slots 28 and the tapered surfaces 40 on the flanges 30 slide along and engage one another when the segments 18, 20 are assembled to thereby enable an easy assembly and a relatively tight wedging fit.

The slots 28 on the liner 24 further include a second tapered surface 42 on each slot and the flanges 30 on the outside interlocking segment 20 further include a cooperating second tapered edge surface 45. The surfaces 42 and 45 slide along and engage one another when the segments 18, 20 are assembled to thereby contribute to ease of assembly and a tight wedging fit.

Figure 4:
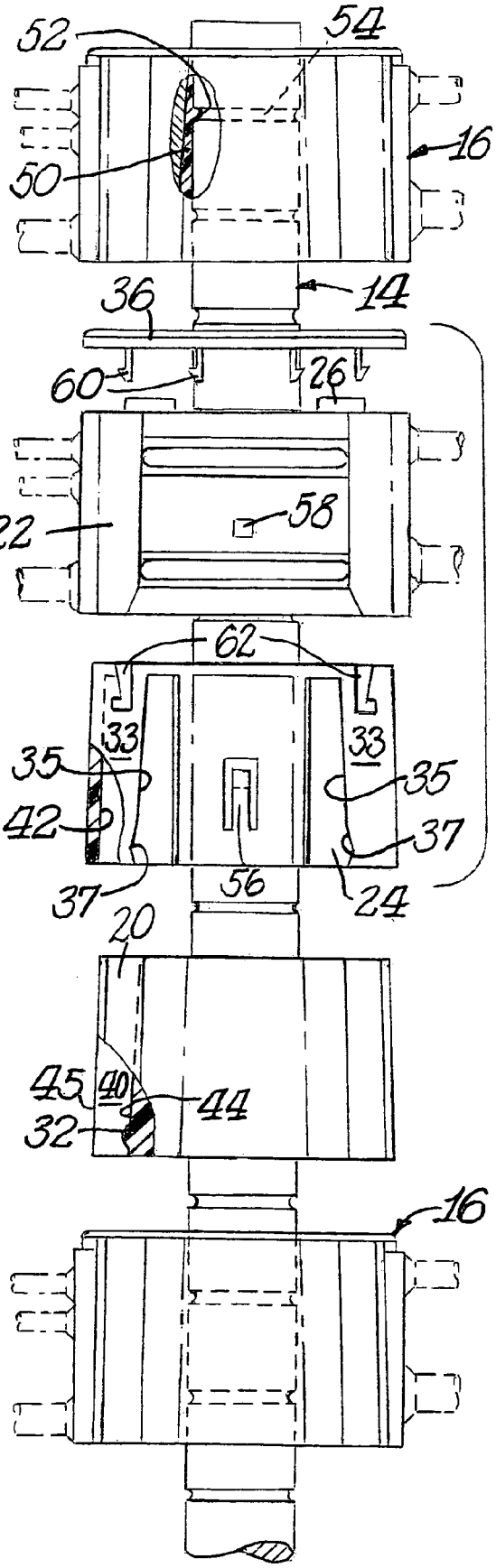
FIG. 4 is a partially exploded view in elevation of the multi-component conical corner structure assembled to a corner post of the shelving unit and also disassembled to illustrate the ease with which the shelf may be removed.
Figure 4B:
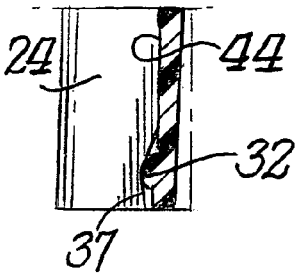
FIG. 4B is a partial sectional view showing the inner liner of the base segment and the outside interlocking assembled together with the undercut recess on the liner snapped over the raised area on the interlocking segment.
Figure 4A:
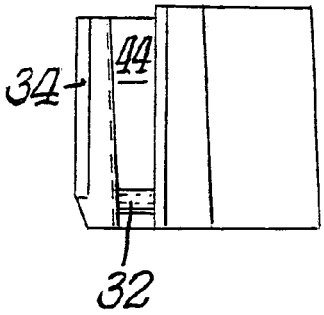
FIG. 4A is a left side elevational view of the outside interlocking segment and the metal liner showing the raised area on the inside of the interlocking segment.
Figure 7:
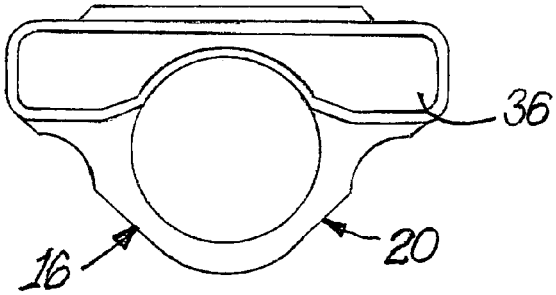
FIG. 7 is a top plan view of the corner structure of FIG. 5.
Figure 5:
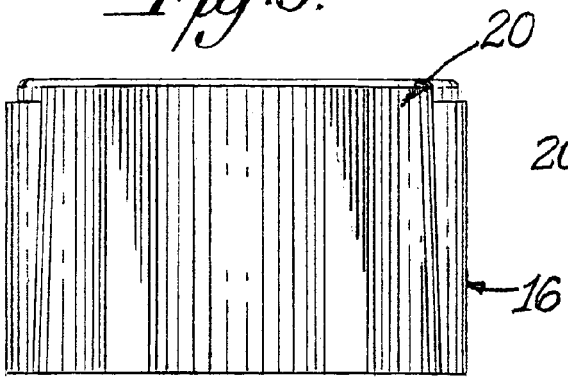
FIG. 5 is a front elevational view of an assembled multi-component conical corner structure, according to the present invention.
Figure 6:
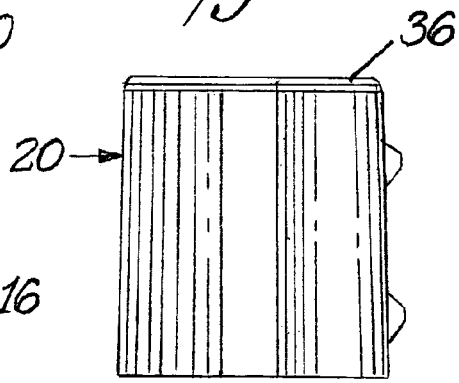
FIG. 6 is a right side elevational view of the corner structure of FIG. 5.
Figure 8:
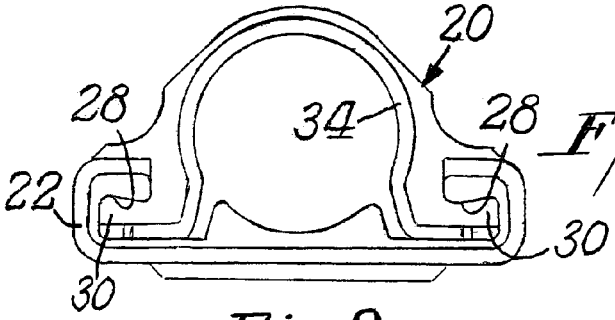
FIG. 8 is a bottom plan view of the corner structure of FIG. 5.
Figure 10:
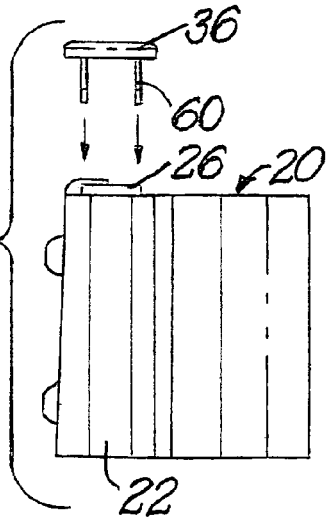
FIG. 10 is a left side elevational view of the corner structure of FIG. 5 with the cover cap being inserted.
Figure 9:
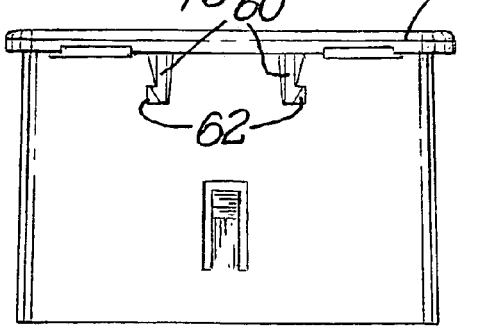
FIG. 9 is a rear elevational view of the corner structure of FIG. 5.

The two piece base segment 18 and the outside interlocking segment 20 snap fit together when assembled, and in this regard tapered surfaces 44 on segment 20 each include a raised area 32. In turn, the inner liner 24 includes spaced apart front faces 33 each with a generally vertically oriented edge 35 having an undercut recess 37. As shown in FIGS. 4, 4A and 4B, the edges 35 slide along the tapered surfaces 44 when the parts are assembled and the undercut recesses 37 snap fit over the raised areas 32 to releasable lock the parts together. Positive full engagement increases as downward force is applied from loading on the shelf 12 which prevents unwanted disengagement and "walking" which might otherwise occur when the shelving unit 10 is moved in a lateral direction.

The inner liner 24 of the two piece base segment 18 and the metal liner 34 of the outside interlocking segment 20 each include a partial frusto conical surface portion, 46, 48, respectfully, to facilitate releasable connection of the shelf or shelves 12 to the upright posts 14 of the shelving unit 10. In this regard, a two piece frusto conical clamping sleeve 50 is constructed and arranged for connection to a post 14 at an elevation where the shelf is to be positioned in the overall shelving unit. The clamping sleeve has a cylindrical interior surface with a diameter the same or just slightly larger than the outside diameter of the post, and an inwardly directed annular rib 52 on the inside of the collar engages within an annular groove 54 on the post to thereby physically connect the collar to the post at the desired elevation. The outside of the clamping sleeve is frusto conical in shape, and the partial frusto conical surface portions 46, 48 on the liner 24 and the metal inner liner 34 engage the collar 50 to releasably attach the corner 16 of the shelf to the post 14 when the components are assembled together.

As noted above, the housing 22 and the liner 24 of the two piece base segment 18 are releasably secured together in their assembled condition. In this regard, the inner liner 24 may include a flexible flap 56 with a locking tab at the free end thereof that fits within an opening 58 in the housing 22 to lock the liner within the housing. Moving the flap 56 and its locking tab away from the opening enables removal of the inner liner from the housing.

The releasable connection of the cover cap is achieved by a plurality of downwardly extending prongs 60 on the underside of the cap that are received in cooperating slots 62 at the top of the inner liner 24.

We claim:

1. A shelving unit comprising a plurality of upright support posts, a shelf having multiple corners, and a multi-component corner structure at each corner of the shelf for releasably connecting the shelf to the posts, each corner structure comprising a two piece base segment and a substantially frictionless outside interlocking segment, the two piece base segment including a housing fixedly connected to a shelf corner and a substantially frictionless inner liner within the housing, a stop on an upper portion of the housing engaging the inner liner to prevent upward movement of the liner beyond the upper portion of the housing, the inner liner having vertically oriented opposed undercut slots and the outside interlocking segment having vertically oriented opposed outwardly directed flanges that engage within the slots when the base and outside interlocking segments are releasably connected together, and the stop on the upper portion of the housing engaging the outwardly directed flanges on the outside interlocking segment to prevent upward movement of outside interlocking segment beyond the upper portion of the housing.

2. A shelving unit as in claim 1 wherein the slots of the inner liner each includes an upwardly and inwardly tapered surface and the flanges on the outside interlocking segment each includes a cooperating downwardly and outwardly tapered surface.

3. A shelving unit as in claim 2 wherein the slots of the inner liner each further include a second tapered surface and the flanges on the outside interlocking segment each further includes a cooperating second tapered edge surface.

4. A shelving unit as in claim 3 wherein the second tapered surfaces on the outside interlocking segment each includes a raised area and the inner liner includes opposed undercut recesses that snap fit over the raised areas to releasably lock the outside interlocking segment to the inner liner when assembled.

5. A shelving unit as in claim 1 wherein the outside interlocking segment includes a metal liner on an inside surface thereof.

6. A shelving unit as in claim 5 including a frusto conical clamping sleeve connected to each post at an elevation where a shelf is to be positioned, the frusto conical clamping sleeve having a frusto conical outside surface, and wherein the inner liner of the base segment and the metal liner of the outside interlocking segment of each corner structure include partial frusto conical surface portions that engage the outside surface of the clamping sleeves when the base and interlocking segments are releasably connected together.

7. A shelving unit as in claim 6 wherein the outside interlocking segment of each multi-component corner structure and the metal liner on the inside surface thereof extend slightly more than 180° around its associated frusto conical clamping sleeve.

8. A shelving unit as in claim 1 wherein the outside interlocking segment and the inner liner of the base segment are fabricated from nylon polymer.

9. A shelving unit as in claim 1 wherein the multi-component corner structure further includes a releasably connected cover cap over the base and interlocking segments when assembled.

10. A shelving unit as in claim 9 wherein the cover cap includes downwardly extending prongs on an under surface thereof, and slotted openings in the upper portion of the inner liner constructed and arranged to releasably receive the prongs.

11. A shelving system as in claim 1 wherein the inner liner is releasably connected to the housing.

12. A shelving unit as in claim 1 wherein the outside interlocking segment includes at least one raised area and the inner liner of the two piece base segment includes at least one undercut recess that snap fits over the raised area on the outside interlocking segment to releasably secure that segment to the inner liner when assembled together.

* * * * *